United States Patent [19]

Elderfield

[11] Patent Number: 4,717,273

[45] Date of Patent: Jan. 5, 1988

[54] MULTIPLE PAPER HOLDER AND METHOD FOR A COMPUTER PRINTER

[76] Inventor: Keith C. Elderfield, 3300 Whittier Avenue, Victoria, B.C., Canada, V8Z 3C9

[21] Appl. No.: 928,320

[22] Filed: Nov. 7, 1986

[51] Int. Cl.[4] ..... B41J 11/26

[52] U.S. Cl. ..... 400/613.2; 226/196; 400/691

[58] Field of Search ..... 400/606, 608, 610, 610.1, 400/613, 613.1, 613.2, 613.4, 691; 226/196

[56] References Cited

U.S. PATENT DOCUMENTS

| | | | |
|---|---|---|---|
| 1,373,700 | 4/1921 | Avery | 400/606 X |
| 1,419,649 | 6/1922 | Smith | 400/606 |
| 1,616,071 | 2/1927 | Waldheim | 400/613.4 X |
| 1,897,654 | 2/1933 | Pfeiffer et al. | 400/613.2 X |
| 1,930,202 | 10/1933 | Jensen | 400/606 X |
| 2,610,723 | 9/1952 | Fleischmann et al. | 400/613.4 |
| 4,390,296 | 6/1983 | Siegenthaler | 400/608 |
| 4,431,237 | 2/1984 | Evans | 312/184 |
| 4,515,490 | 5/1985 | Marker, III | 400/613.2 |

*Primary Examiner*—Edgar S. Burr
*Assistant Examiner*—Moshe I. Cohen
*Attorney, Agent, or Firm*—Hughes & Cassidy

[57] ABSTRACT

A multiple paper holding apparatus having a mounting plate positioned adjacent a rear infeed end of a computer printer. The free ends from several paper sources are mounted in related slots and over the top edge of the mounting plate, and releasable pin means engaging edge apertures of the paper releasably hold the paper in place. Thus a selected one of the paper sources can be conveniently fed into the printer.

18 Claims, 9 Drawing Figures

MULTIPLE PAPER HOLDER AND METHOD FOR A COMPUTER PRINTER

BACKGROUND OF THE INVENTION

The present invention relates to an apparatus and method for making multiple paper sources available for convenient insertion into a printer, such as a computer printer.

BACKGROUND ART

Quite commonly, a computer printer is placed on a printer stand, and the paper which is to be fed into the computer is positioned on the floor a short distance behind the printer. This is commonly prefolded paper, which is sometimes called "continuous recording web" or "printing stock". This paper has a main center portion upon which the printing is made, and there are two edge portions having regularly spaced alignment and feed apertures suitable for use with a tractor feed in the printer.

When only one type of paper is being used, it is a general practice to take the free end of the paper and place it at a location on the upper rear portion of the printer, with a wire frame or bar holding the free end of the paper at that location. For example, the paper can be folded over at the location of one of the transverse perforated lines which are located at regularly spaced intervals along the lengthwise access of the continuous paper stock. When it is desired to print on this continuous paper, the free end of the paper is simply fed into the printer. Upon completion of a printing cycle, the paper is separated along the closest perforated line, and the newly created free end of the paper is then folded back over against the bar to hold it at a readily accessible location for a subsequent printing cycle.

In some situations, it is desirable to have several different types of paper of the same size and configuration, for example, one supply of white paper, and two additional supplies of paper of different colors. In this situation, quite often the three different supplies of paper are placed on the floor behind the printer. To feed a different type of paper into the printer, it is necessary for the operator to reach below the printer stand to grasp the free end of the paper to be inserted, and then to move that paper upwardly behind the printer and feed it into the printer.

A search of the Patent literature has disclosed a number of patents in this general area, these being the following.

U.S. Pat. No. 4,515,490—Marker, III, shows a structure where there are several stacks of folded paper, with the free end portions of the paper from each stack being kept in position by being folded over plate-like guide members. When one source of paper is to be used, it is pulled upwardly from the guide member into engagement with the printer.

U.S. Pat. No. 4,431,237—Evans, shows a cabinet for storing and selectively dispensing different supplies of paper. This is mounted on a turntable.

U.S. Pat. No. 4,390,296—Siegenthaler, shows a system in which various webs are retained in grippers 8 and 9. When one of the webs is required, the gripper is moved so that the web material is forced between the rollers 1, and drawn into the printing device.

U.S. Pat. No. 2,610,723—Fleischmann et al, shows a storage structure where there are folded strips of papers which are stacked in vertically spaced compartments, and these are selectively loaded into a typewriter.

U.S. Pat. No. 1,930,202—Jensen, shows a paper folding machine where there are spring engaged pins 19. These are carried by a rock-shaft 19*a* and tend to be thrown rearwardly by a spring 19*b* to draw the webs 16 rearwardly so as to stretch them taut on the platen 12.

U.S. Pat. No. 1,897,654—Pfeiffer et al, shows a device for taking a plurality of sheets of paper and feeding these at separate locations in a printing device.

U.S. Pat. No. 1,616,071—Waldheim, shows a cabinet structure that is positioned below the platform of a table. Several sets of folded paper are placed in this cabinet, and these are selectively fed into a printing device.

U.S. Pat. No. 1,419,649—Smith, shows a device that feeds groups of paper webs to a typewriter. Each paper has a gripping device in the form of a spring pressed bar 47 which is held down by the spring 58 against a fixed bar 59.

In U.S. Pat. No. 1,373,700—Avery, there is a device that selectively feeds stored sheets of paper to a typewriter. There is a gear drive which can feed the several sheets simultaneously, while less than all of the sheets selectively.

SUMMARY OF THE INVENTION

The present invention comprises a paper feeding apparatus and method of using the same, and also a printing and paper feeding combination, comprising a printer and the paper feeding apparatus.

In the combination, there is a printer having a manually accessible infeed location to receive paper having spaced apertures along a lengthwise axis thereof. The paper feeding apparatus is positioned adjacent to the printer and is adapted to position free ends of paper from a plurality of paper sources at the infeed location for selective feed of the paper into the printer.

The paper feeding apparatus of the present invention comprises a paper locating section, and also a base section to which the paper locating section is mounted in a manner to position the paper locating section at the infeed location. The paper locating section defines a plurality of slot means spaced from one another, with each slot means positioned and arranged at respective slot locations to receive a free end portion of a respective paper source and to position the free end portion to be manually accessible at the infeed location to be fed into the printer for travel in an infeed direction.

There is a plurality of paper retaining members, each of which is positioned at a related slot location and having a retaining element with a first retaining position to engage at least one of the edge apertures of the paper in a manner to prevent travel of the pape in a direction opposite to the infeed direction. Each retaining element is mounted in its paper retaining member to be moveable to a nonretaining position so as to permit free movement of the paper from its related source in an infeed direction into the printer.

In the particular embodiment shown herein, the base section comprises a support platform adapted to be positioned below the printer so that the printer will be resting on the platform, which in turn is positioned on an underlying support surface. The paper locating section comprises a paper support structure connected to a rear end portion of the support platform and extending upwardly therefrom, with the slot means being formed in the paper support structure. The paper support structure has a lower portion, provided with cutout means to accommodate appendages of the printer.

In the specific embodiment shown herein, each of the paper retaining members comprises a pin means which extends upwardly in the retaining position, and which is deflectable downwardly and forwardly in a direction generally parallel with said infeed direction to said nonretaining position. Each of said pin means is pivotally mounted for movement between the retaining position and the nonretaining position. The pin means is provided with stop surfaces to limit rearward movement of the pin means beyond the retaining position, and to limit downward movement of the pin means beyond the nonretaining position.

Another desirable feature of the present invention is that one of the slot means is a first slot which is adapted to receive a first and second paper source of a predetermined, standard width. This first slot has a horizontal lengthwise dimension greater than said standard width to an extent that said first paper source can be positioned at a first location adjacent a first end of said first slot, and said second paper source can be positioned at a second location adjacent a second end of said first slot. Two of the paper retaining members are positioned adjacent opposite ends of the first slot, in a manner that the first paper source engages one of the retaining members at the first slot, while the second paper source engages the other of the retaining members at said first slot.

Also, in this specific embodiment, the paper support structure of the paper locating section has an upper paper support means having a first open end portion, and a second end portion at which is positioned a selected one of said paper retaining members, whereby a paper source having a relatively large dimension can be positioned at said paper support portion and extend beyond the open end thereof, while being retained by said selected paper retaining member.

In a specific embodiment, the paper support structure has a plurality of slots having paper retaining members at opposite ends thereof, and an upper unobstructed support edge portion, having a first open end, and a second end with a paper retaining member thereat.

Other features will become apparent from the following detailed description.

In the method of the present invention, an apparatus is provided as described above. A plurality of paper sources are provided, and the free ends of these paper sources are inserted in respective slot means of the apparatus. Retaining elements of respective retaining members are inserted in edge apertures of the free end of each paper source to retain the free ends at a conveniently accessible location. To feed the free end of a selected paper source into the printer, the free end is pulled in an infeed direction to cause release of the related retaining member. Upon completion of the printing, the free end of the paper source can be moved rearwardly into engagement with its related retaining member.

DESCRIPTION OF THE PREFERRED EMBODIMENT

Figure 1:
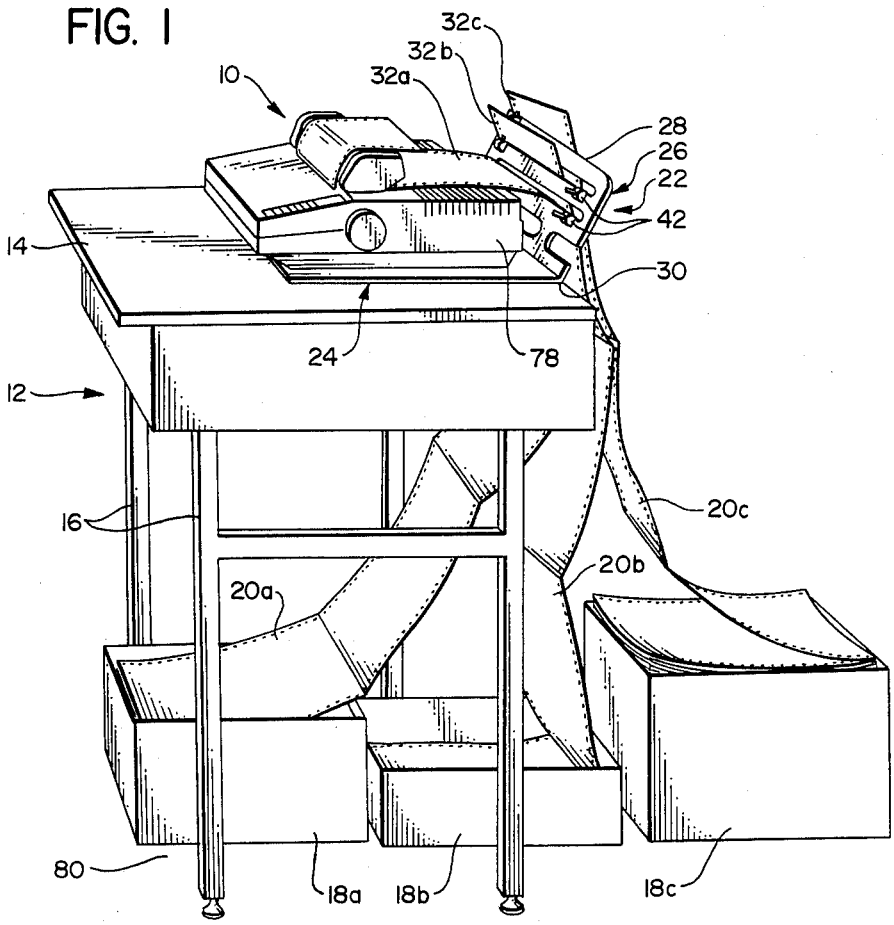
FIG. 1 is an isometric view illustrating the paper feeding apparatus of the present invention used in conjunction with a conventional printer.

In FIG. 1, there is shown a typical prior art computer printer 10 resting on a table 12 having an upper platform 14 and support legs 16. Positioned below the table platform 14 are three boxes or containers 18*a*, 18*b* and 18*c*, each of which contains a supply or source of prefolded paper, these paper supplies being designated 20*a*, 20*b* and 20*c*, respectively.

The apparatus of the present invention is generally designated 22, and this comprises a base support section 24 and a paper locating section 26. The base support section 24 is conveniently made as a flat rectangular plate which in operation is simply placed on top of the table platform 14, with the printer 10 resting on top of the support platform 24. In this particular embodiment, the base section 24 is shown as a full platform so that the present invention can be conveniently used with a conventional printer 10 without any special attaching devices. However, it is to be understood that within the broader scope of the present invention, the base support 24 for the paper locating section 26 could be made as part of the printer 10 or as a separate mounting device or bracket attached to the printer 10.

The paper locating section 26 comprises a planar, generally rectangularly shaped support structure 28 that extends upwardly at a moderate rearward slant from the rear edge 30 of the support platform 24. This planar support structure 28 can be made integral with the base support platform 24 as a single molded plastic piece. The main function of the paper locating section 26 is to position the free ends 32*a*, 32*b* and 32*c* of the paper supplies 20*a*, 20*b* and 20*c* at a conveniently accessible location immediately behind the printer 10, and accomplish this in a manner that the free ends 32*a*, 32*b* and 32*c* of the paper source can be conveniently moved into operating engagement with the printer 10 and fed therethrough in an unobstructed manner.

Figure 2:
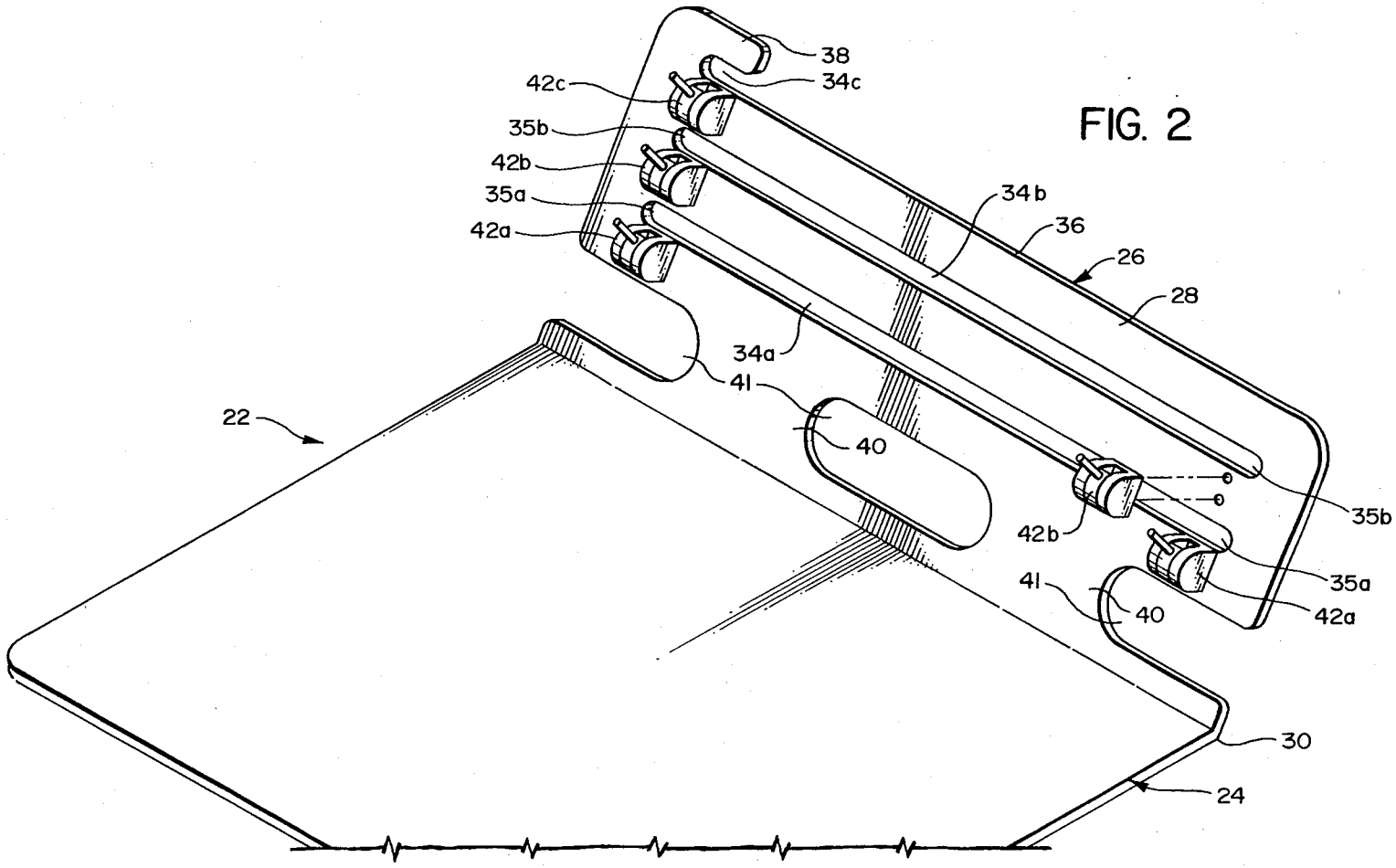
FIG. 2 is an isometric view of the paper feeding apparatus of the present invention.

With regard to the particular configuration of the support structure 28 of the paper locating section 26, reference is made to FIG. 2. The structure 28 is formed with two elongate laterally extending slots, namely a first lower slot 34*a*, and a second slot 34*b* positioned a short distance (e.g., one to two inches) above the first lower slot 34*a*. These two slots 34*a* and 34*b* are closed at end portions thereof, designated 35*a* and 35*b*, respectively. The horizontal lengthwise dimension of each of these slots 34*a* and 34*b* (i.e., measured from the end portions 35*a* and 35*b*, respectively) is moderately greater than the width dimension of a smaller standard width paper which is fed through the printer. At present, the total width of such paper (including the removeable edge portions) is about 9½ inches. Accordingly, in this particular embodiment, the horizontal width dimension of each of the slots 34a and 34b is about 13½ to 14 inches. Obviously, the length dimension of these slots 34a and 34b could be varied. These two slots 34a and 34b receive the free ends 32a and 32b of the paper sources 20a and 20b, respectively. The manner in which the formation of these slots 34a and 34b enhances the operation of the presention will be discussed later herein.

The free end 32c of the third paper supply 20c is positioned over the top edge 36 of the support structure 28. There is a positioning finger 38 which extends a short distance over one end portion of the top edge 36 to form a relatively short end slot 34c which receives an edge portion of the free end 32c of the paper supply 22c.

The support structure 28 is connected to the base support platforms 34 by means of two legs 40 which in this particular embodiment are formed as part of the integral structure of the base support section 24 and the support structure 28. By forming the support plate or structure 28 with the two legs 40, there are provided cutouts or openings 41 at middle and end locations at the lower part of the support structure 28. These openings 41 are to accommodate cables or other appendages associated with the printer 10.

As indicated previously, instead of providing the base support section 24 as a full platform positioned beneath the printer 10, within the broader scope of the present invention, these support legs 40 could be connected to another type of base support structure, or connected directly to structure of the printer 10, in which case the legs 40 would then be considered as the base support section 24.

The paper locating section 26 comprises, in addition to the support structure 28, a plurality of paper retaining members 42. The function of these retaining members 42 is to position the three paper free ends 32a, 32b and 32c within the slots 34a, 34b and 34c, and yet to release the paper free ends 32a, 32b and 32c when these are pulled forwardly into operative engagement with the printer 10. Two of these retaining members 42a are positioned just below and at opposite ends of the slot 34a; two more retaining members 42b are positioned just below and at opposite ends of the second slot 34b; and, a single retaining member 42c is positioned just beneath the very short third slot 34c.

With reference to FIGS. 3–8, each retaining member 42 comprises a U-shaped mounting bracket 44 having a flat base 46, which fits against the surface 48 of the support structure 28, and two side plates 50 which define a receiving recess 52. The bracket 44 has a pair of mounting pins 54 extending outwardly therefrom to fit into matching holes in the support structure 28 so as to fixedly mount the bracket 44 to the structure 28. The exposed forward edge surfaces 56 of the two side plates 50 are desirably formed in a circular curve.

Each paper retaining member 42 further comprises a moveable retaining portion comprising a retaining finger 58 mounted to a hub 60. The hub 60 is pivotally mounted in the recess 52 of the bracket 44, this being accomplished by forming on the inner surfaces 62 of the two side plates 50 two circular protruding members 64 positioned oppositely to one another, with these two protruding member 64 fitting in ends of a through opening 66 in the hub 60. The outer exposed edge surface 68 of the hub 60 is circularly curved to match the edge surfaces 56 of the legs 50 of the bracket 44. The side plates 50 yield sufficiently to enable the hub 60 to be snapped into place in the recess 52.

Figure 7:
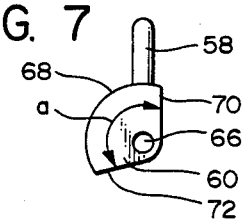
FIG. 7 is a side elevational view of the moveable retaining element of the paper retaining member.
Figure 8:
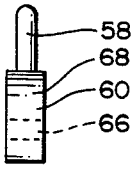
FIG. 8 is a front elevational view of the element in FIG. 7.

Additionally, the hub 60 is formed with two stop surfaces, namely an upper stop surface 70 and a lower stop surface 72, with these two surfaces meeting each other at an angle of about 120° or slightly less (indicated at "a" in FIG. 7). The pivot mounting of the hub 60 (formed by the protruding members 64 and the opening 66) is positioned relative to the stop surfaces 70 and 72 so that one or the other of the stop surfaces 70 and 72 comes into engagement with a matching surface 74 of the base portion 46 of the bracket 44, in a manner to permit approximately 60° rotation (or moderately greater than 60° ) of the retaining finger 58.

Figure 3:
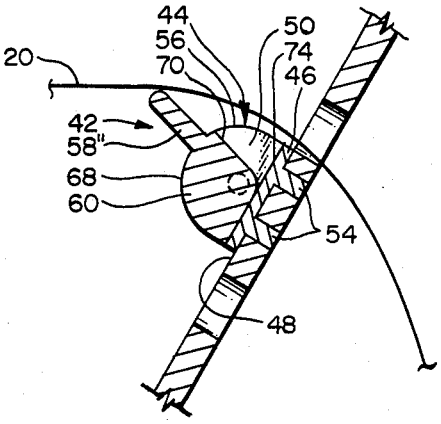
FIG. 3 is a sectional view taken through a support plate of the present invention, and showing a retaining finger of a paper retaining member in its release position.
Figure 4:
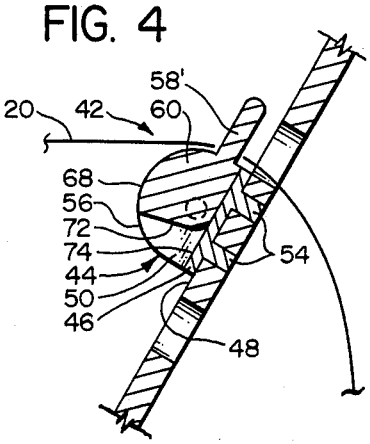
FIG. 4 is a view similar to FIG. 3, but showing the retaining finger in its upright retaining position.
Figure 5:
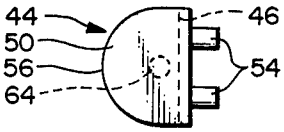
FIG. 5 is a side elevational view of a support bracket of the paper retaining member.
Figure 6:
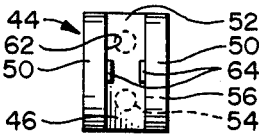
FIG. 6 is a front elevational view of the bracket of FIG. 5.

Each of the retaining members 42 is so positioned that the retaining finger 58 has a vertically upstanding retaining position, (indicated at 58' in FIG. 4), and a forwardly and slightly upwardly extending release position (indicated at 58'' in FIG. 3). In the upstanding retaining position, the upper stop surface 70 engaging the surface 74 prevents any further rearward movement of the finger 58, while engagement of the lower stop surface 72 against the surface 74 limits any further downward rotation of the finger 58.

Figure 9:
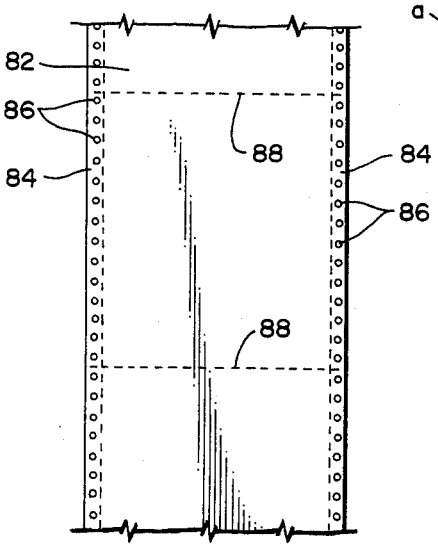
FIG. 9 is a plan view illustrating tractor fed paper which is used in conjunction with the present invention.

As illustrated in FIG. 9, the particular type of paper particularly adapted to be used in connection with the present invention is a standard type of tractor fed paper having a main middle printing portion 82, and two edge portions 84. The edge portions 84 are provided with a plurality of evenly spaced circular apertures 86 which are located to engage the tractor feed of the printer 10. Perforated transverse tear lines 88 are provided at spaced locations along the lengthwise axis of the paper.

To describe the operation of the present invention, the apparatus 22 is located in its operating position by placing the rectangular base support platform 24 on top of the table platform 14. The printer 10 is then placed on top of the base support section or platform 24, with the components being arranged so that the paper locating section 26 extends upwardly with a moderately rearward slant behind the rear portion 78 of the printer 10.

As shown in FIG. 1, there are three paper supplies or sources 20a, 20b and 20c, and the mode of operation will first be described with reference to the use of three paper sources. As will be described later herein, it is possible to use the present invention with a greater number of paper supplies or sources.

The three paper containers 18a, 18b and 18c are positioned on the floor 80 or some other support location, and the free ends 32a, 32b and 32c of the three paper supplies 20a, 20b and 20c are pulled upwardly with the two free ends 32a and 32b being passed forwardly through, respectively, the first and second slots 34a and 34b.

One of the apertures 86 of each of the first and second paper free ends 32a and 32b is placed into engagement with one of the related retaining fingers 58 which are positioned immediately below the respective slots 32a and 32b. On the assumption that the paper 22a or 22b is of a smaller standard width (i.e., 9½ inches), the paper must be moved moderately sideways to cause the aperture 86 to come into engagement with the related finger 58. With the finger engaging the aperture 86, the weight of the paper extending rearwardly and downwardly from the slots 34a and 34b tends to pull the free paper ends 32a and 32b rearwardly out of the slots 34a and 34b, and the engaged retaining finger 58 remains positioned upwardly in its upright retaining positions. Thus, the free ends 32a and 32b of the paper supplies 20a and 20b are held at a conveniently, accessible location immediately behind the printer 10 and forward of the support plate 28.

In like manner, the free end 32c of the third paper supply 20c is positioned over the top edge 36 of the support structure 28, with one of the edge apertures 86 being brought into engagement with the finger 58 of the retaining member 42c which is positioned just below the upper slot portion 34c. This single retaining finger 58 engaging one side of the paper free end 32c is sufficient to retain the free end 32c of the paper supply 20c in an accessible location over the top edge 36 of the support structure 28. The fact that the top edge 36 permits the paper 20c to extend over its one open end would enable the present apparatus 22 to have one paper source of a rather large width dimension so that it could extend laterally beyond the top edge 36.

As indicated previously, the three paper supplies 20a, 20b and 20c, will likely differ in some manner from one another, possibly being of different color. When it is desired to feed a particular one of the paper supplies 20a, 20b or 20c into the printer 10, the selected free end 32a, 32b or 32c is pulled forwardly (and possibly upwardly) from the paper locating section 26. As this is done, the related retaining finger 58 that is engaging that particular paper free end deflects forwardly and downwardly to the release position, where that finger 58 extends forwardly and moderately upwardly as at 58" in FIG. 3. In that location, the paper can easily slip off the retaining finger or fingers 58. Then, the paper 20a, 20b or 20c is simply centered relative to the printer 10 and fed through the printer by the conventional tractor feed in the printer 10. If the paper 20a, 20b or 20c has a width smaller than the lengthwise dimension of its related slot 32a or 32b, then the centering of the paper will move the paper away from the related retaining member 42a or 42b. In the event that the paper 20a or 20b is as wide as the length of the related slot 32a or 32b, then the edge portions of the paper are able to pass over the pins 58 as it is fed into the printer.

At the completion of the printing operation, the portion of the paper supply which has not yet been fed into the printer is separated from the paper supply that has passed through the printer 10, this being accomplished usually simply by separating the paper along one of the transverse tear lines 88, thus forming a new free end 32a, 32b or 32c. Then the newly created free end of the paper is simply moved rearwardly a short distance so as to be out of the way of the printer 10 and a selected perforation 86 along one edge of the paper is manually brought into engagement with the related retaining finger 58. When the paper is released, the weight of the paper supply 20a, 20b or 20c behind the locating section 26 tends to pull that particular paper supply 20a, 20b or 20c rearwardly through its related slot and downwardly, thus causing the related retaining finger 58 to move up to its upright hold position and thus position the free end 32a, 32b or 32c of the paper supply 20a, 20b or 20c at the appropriate location.

Thus, it can readily be recognized that the free ends 32a, 32b and 32c of the three paper supplies 20a, 20b or 20c are all conveniently positioned for easy manual access for a person who is standing in front of the printer 10. Further, the apparatus 22 is arranged so that the paper free ends 32a, 32b or 32c are at all times readily available to be grasped manually and moved into feeding engagement with the printer 10. Also, while the retaining fingers 58 can reliably perform their retaining function, the forward and moderately upward pulling motion on the paper free end 32a, 32b or 32c causes a convenient release of the paper from the retaining finger 58, with the retaining finger or fingers 58 presenting no obstacle for the unobstructed feeding of the selected paper source 20a, 20b or 20c into the printer 10.

The fact that the horizontal length dimensions of these slots 34a and 34b are made moderately larger than the usual width dimension of the conventional smaller width paper (i.e., at present 9½ inch paper width) provides another convenience. It is possible to insert two paper supplies through one of these slots 34a or 34b, with one of the paper sources having an edge aperture 86 engaging one of the fingers 58 of one of the retaining elements 42a or 42b, while the other paper source can be moved to the opposite end of the slot to engage an oppositely positioned finger 58. While the two paper sources would overlap one another to some extent in the slot 34a or 34b, it has been found that this creates no problem with the proper feeding of one or the other of the paper sources into the printer 10.

It is to be recognised that various modifications could be made in the present invention without departing from the basic teachings thereof.

What is claimed:

1. A printing and paper feeding combination comprising:

(a) a printer having a manually accessible infeed location to receive paper having spaced apertures along a lengthwise axis thereof, (b) a paper feeding apparatus adapted to position free ends of paper from a plurality of paper sources at the infeed location for selective feed of the paper into the printer, said apparatus comprising:

(i) a paper locating section, (ii) a base section to which said paper locating section is mounted in a manner to position said paper locating section at the infeed location, (iii) said paper locating section defining a plurality of slot means spaced from one another, with each slot means positioned and arranged at respective slot locations to receive a free end portion of a respective paper source and to position said free end portion to be manually accessible at said infeed location to be fed into said printer for travel in an infeed direction, and (iv) a plurality of paper retaining members, each positioned at a related slot location and having a retaining element having a first retaining position to engage at least one of said edge apertures of said paper in a manner to prevent travel of said paper in a direction opposite to said infeed direction, each retaining element being mounted in its paper retaining member to be moveable to a nonretaining position so as to permit free movement of the paper from its related source in an infeed direction into the printer.

2. The combination as recited in claim 1, wherein said base section comprises a support platform adapted to be positioned below said printer so that said printer would be resting on said platform, which in turn is positioned on an underlying support surface.

3. The combination as recited in claim 2, wherein said paper locating section comprises a paper support structure connected to a rear end portion of said support platform and extending upwardly therefrom, with said slot means being formed in said paper support structure.

4. The combination as recited in claim 3, wherein said paper support structure has a lower portion, provided with cutout means to accommodate appendages of said printer.

5. The combination as recited in claim 1, wherein each of said paper retaining members comprises a pin means which extends upwardly in the retaining position, and which is deflectable downwardly and forwardly in a direction generally parallel with said infeed direction to said nonretaining position.

6. The combination as recited in claim 5, wherein each of said pin means is pivotally mounted for movement between the retaining position and the nonretaining position, said pin means being provided with stop surfaces to limit rearward movement of the pin means beyond the retaining position, and to limit downward movement of the pin means beyond the nonretaining position.

7. The combinationas recited in claim 1, wherein at least one of said slot means is a first slot and is adapted to received a first and second paper source of a predetermined standard width, said first slot having a horizontal lengthwise dimension greater than said standard width to an extent that said first paper source can be positioned at a first location adjacent a first end of said first slot, and said second paper source can be positioned at a second location adjacent a second end of said first slot, two of said paper retaining members being positioned adjacent opposite ends of said first slot, in a manner that said first paper source engages one of said retaining members at said first slot, while said second paper source engages by the other of said retaining members at said first slot.

8. The combination as recited in claim 1, wherein:

(a) said base section comprises a support platform adopted to be positioned below said printer, with said printer resting on said platform, (b) said paper locating section comprises a paper support structure connected to a rear end portion of said support platform and extending upwardly therefrom, said slot means comprising a plurality of vertically spaced slots formed in said paper support structure, (c) a pair of said paper retaining members being positioned adjacent to and beneath opposite end portions of each of said slots, (d) at least one of said paper retaining members being positioned adjacent one end of a top edge portion of said paper support structure, with the top edge portion presenting at least one unobstructed end portion to receive paper of a relatively large width, (e) each of said paper retaining members comprises a pin means which extends upwardly in the retaining position, and which is deflectabe downwardly and forwardly to said nonretaining position.

9. A paper feeding apparatus adapted to position free ends of paper from a plurality of paper sources for selective feed of the paper into a printer, where the printer has a manually accessible infeed location to receive paper heaving spaced apertures along a lengthwise axis thereof, said apparatus comprising:

(a) a paper locating section, (b) a base section to which said paper locating section is mounted to position said paper locating section at the infeed location, (c) said paper locating section defining a plurality of slot means spaced from one another, with each slot means positioned and arranged at respective slot locations to receive a free end portion of a respective paper source and to position said free end portion to be manually accessible at said infeed location to be able to be fed into said printer for travel in an infeed direction, and (d) a plurality of paper retaining members, each positioned at a related slot location and having a retaining element having a first retaining position to engage at least one of said edge apertures of said paper in a manner to prevent travel of said paper in a direction opposite to said infeed direction, each retaining element being mounted in its paper retaining member to be moveable to a nonretaining position so as to permit free movement of the paper from its related source in an infeed direction into the printer.

10. The apparatus as recited in claim 9, wherein said base section comprises a support platform adapted to be positioned below said printer so that said printer would be resting on said platform, which in turn is positioned on an underlying support surface.

11. The apparatus as recited in claim 10, wherein said paper locating section comprises a paper support structure connected to a rear end portion of said support platform and extending upwardly therefrom, with said slot means being formed in said paper support structure.

12. The apparatus as recited in claim 11, wherein said paper support structure has a lower portion, provided with cutout means to accommodate appendages of said printer.

13. The apparatus as recited in claim 9, wherein each of said paper retaining members comprises a pin means which extends upwardly in the retaining position, and which is deflectable downwardly and forwardly in a direction generally parallel with said infeed direction to said nonretaining position.

14. The apparatus as recited in claim 13, wherein each of said pin means is pivotally mounted for movement between the retaining position and the nonretaining position, said pin means being provided with stop surface to limit rearward movement of the pin means beyond the retaining position, and to limit downward movement of the pin means beyond the nonretaining position.

15. The apparatus as recited in claim 9, wherein at least one of said slot means is a first slot and is adapted to receive a final and second paper source of a predetermined standard width, said first slot having a horizontal lengthwise dimension greater than said standard width to an extent that said first paper source can be positioned at a first location adjacent a first end of said first slot, and said second paper source can be positioned at a second location adjacent a second end of said first slot, two of said paper retaining members being positioned adjacent opposite ends of said first slot, in a manner that said first paper source engages one of said retaining members at said first slot, while said second paper source engages by the other of said retaining members at said first slot means.

16. The apparatus as recited in claim 9, wherein:

(a) said base section comprises a support platform adopted to be positioned below said printer, with said printer resting on said platform, (b) said paper locating section comprises a paper support structure connected to a rear end portion of said support platform and extending upwardly therefrom, said slot means comprising a plurality of vertically spaced slots formed in said paper support structure, (c) a pair of said paper retaining members being positioned adjacent to and beneath opposite end portions of each of said slots, (d) at least one of said paper retaining members being positioned adjacent one end of a top edge portion of said paper support structure, with the top edge portion presenting at least one unobstructed end portion to receive paper of a relatively large width, (e) each of said paper retaining members comprises a pin means which extends upwardly in the retaining position, and which is deflectable downwardly and forwardly to said nonretaining position.

17. A method of selectively feeding paper having spaced apertures along a lengthwise axis thereof from a plurality of paper sources to a printer having a manually accessible infeed location, said method comprising:

(a) providing a paper feeding apparatus comprising:

(i) a paper locating section, (ii) a base section to which said paper locating section is mounted in a manner to position said paper locating section at the infeed location, (iii) said paper locating section defining a plurality of slot means spaced from one another, with each slot means positioned and arranged at respective slot locations to receive a free end portion of a respective paper source and to position said free end portion to be manually accessible at said infeed location to be fed into said printer for travel in an infeed direction, and (iv) a plurality of paper retaining members, each positioned at a related slot location and having a retaining element having a first retaining position to engage at least one of said edge apertures of said paper in a manner to prevent travel of said paper in a direction opposite to said infeed direction, each retaining element being mounted in its paper retaining member to be moveable to a nonretaining position so as to permit free movement of the paper from its related source in an infeed direction into the printer, (b) locating said apparatus with the paper locating section adjacent to the infeed location of the printer, (c) providing a plurality of paper sources and inserting the free ends of these paper sources in respective slot means of the apparatus, (d) operating at least some of said paper retaining members to engage edge apertures of the free ends of each paper source to retain the free ends in the slot means, (e) pulling a selected free end of one of said paper sources in an infeed direction and causing release of the related retaining member for that free end of the selected paper source, (f) upon completion of a printing operation, separating a remaining portion of said selected paper source from paper which has been printed, so as to form a new free end of the selected paper source, and moving said new free end rearwardly into engagement with its related retaining member.

18. The method as recited in claim 17, wherein at least one of said slot means is provided as a first slot adapted to receive a first and second paper source of a predetermined standard width, with said first slot having a horizontal lengthwise dimension greater than the standard width, said method further comprising placing said first paper source at a first location adjacent a first end of said first slot and positioning said second paper source at a second location adjacent a second end of said first slot, engaging an aperture in said first paper source with a paper retaining member positioned adjacent one end of said first slot means, and engaging an aperture of said second paper source with a second retaining member at another end of said first slot means, whereby said first and second paper sources are positioned in said first slot for ready access.

* * * * *